US009053887B2

(12) United States Patent
Castaneda Arriaga et al.

(10) Patent No.: US 9,053,887 B2
(45) Date of Patent: Jun. 9, 2015

(54) SWITCHING DEVICE

(71) Applicants: Abel Alejandro Castaneda Arriaga, Guadalupe (MX); Ronald Cone, Douglasville, GA (US); Reinhard Herdegen, Amberg (DE); Ekkehard Plechinger, Röckersbühl (DE); Reinhard Steger, Sulzbach-Rosenberg (DE)

(72) Inventors: Abel Alejandro Castaneda Arriaga, Guadalupe (MX); Ronald Cone, Douglasville, GA (US); Reinhard Herdegen, Amberg (DE); Ekkehard Plechinger, Röckersbühl (DE); Reinhard Steger, Sulzbach-Rosenberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 214 days.

(21) Appl. No.: 13/747,748

(22) Filed: Jan. 23, 2013

(65) Prior Publication Data

US 2013/0220784 A1 Aug. 29, 2013

(30) Foreign Application Priority Data

Feb. 28, 2012 (DE) ..... 10 2012 203 030

(51) Int. Cl.
*H01H 71/02* (2006.01)
*H01H 9/22* (2006.01)
*H01H 71/52* (2006.01)

(52) U.S. Cl.
CPC ..... *H01H 71/025* (2013.01); *H01H 9/22* (2013.01); *H01H 71/521* (2013.01)

(58) Field of Classification Search
USPC ..... 200/293, 296–297, 335, 339; 335/202; 361/627
See application file for complete search history.

(56) References Cited

U.S. PATENT DOCUMENTS

| | | | | |
|---|---|---|---|---|
| 4,754,247 | A * | 6/1988 | Raymont et al. | 335/202 |
| 5,084,689 | A | 1/1992 | Craft et al. | |
| 5,278,531 | A * | 1/1994 | Link et al. | 335/202 |

FOREIGN PATENT DOCUMENTS

| | | | |
|---|---|---|---|
| DE | 4101834 | A1 | 7/1992 |
| DE | 9203533 | U1 | 7/1993 |
| DE | 102007014264 | A1 | 9/2008 |
| EP | 0358482 | A2 | 3/1990 |
| EP | 2259283 | A2 | 12/2010 |
| FR | 1248487 | A | 12/1960 |
| FR | 1264995 | A | 6/1961 |
| FR | 1264995 | A | 6/1961 |
| JP | 2001060429 | A | 3/2001 |
| JP | 2007335275 | A | 12/2007 |

OTHER PUBLICATIONS

German Priority Document for German Application No. DE 10 2012 203 030.1 (Not Yet Published).
Mexican Office Action mailed Mar. 12, 2014.

* cited by examiner

*Primary Examiner* — Edwin A. Leon
(74) *Attorney, Agent, or Firm* — Harness, Dickey & Pierce, P.L.C.

(57) ABSTRACT

A switching device is disclosed, in particular an electrical circuit breaker, including a housing and a switching unit disposed inside the housing. In at least one embodiment, the housing includes an openable housing cover with a switching opening through which a control lever head, which can be moved between an on-position and an off-position, of a control lever for switching the switching unit projects. The switching opening includes an opening contour and the control lever head includes an outer contour, which are aligned with one another such that the control lever head in the on-position prevents any movement of the housing cover via the control lever head, and in the off-position permits a movement of the housing cover via the control lever head.

18 Claims, 5 Drawing Sheets

SWITCHING DEVICE

PRIORITY STATEMENT

The present application hereby claims priority under 35 U.S.C. §119 to German patent application number DE 10 2012 203 030.1 filed Feb. 28, 2012, the entire contents of which are hereby incorporated herein by reference.

FIELD

At least one embodiment of the present invention generally relates to a switching device, in particular an electrical circuit breaker, with a housing and a switching unit disposed inside the housing as well as a method for opening a housing cover of a switching device.

BACKGROUND

Switching devices, in particular electrical circuit breakers, are known and are used to control, regulate and/or monitor electrical outputs in switching cabinets. For example, such switching devices can be used as safety switches. In the case of known switching devices, a housing is generally provided, in the interior of which a switching unit is disposed. The switching unit can be understood as an electrical-mechanical component which for example is used to switch a power circuit on and off.

Furthermore, additional switches, for example auxiliary switches, or additional components can also be used in the interior of such a housing, in order to make additional functions and/or analysis options available. Such auxiliary devices can, as is known, also be added subsequently, so that a switching device can be subsequently altered or upgraded. To enable this, a housing cover which can be opened is provided in known switching devices, which when open allows access to the interior of the housing. In addition known switching devices frequently have a control lever, which can be moved with the aid of a control lever head between an on-position and an off-position, and thus switches on and off the switching unit disposed in the interior of the housing.

In the case of known switching devices it is disadvantageous that regardless of the position of the control lever head it is not certain in what state in respect of the on-position and the off-positions access to the interior of the housing is enabled. In particular it is possible in the case of known switching devices that access to the interior and in particular also to the switching unit is affected when the circuit is still closed by the control lever (on-position). If current is still applied to the switching device, in particular the switching unit, there is a risk of damage to the switching device or even a risk to the health of the personnel operating such a switching device.

SUMMARY

At least one embodiment of the present invention is directed to a switching device which eliminates, at least in part, at least one of the above-mentioned disadvantages of known switching devices. At least one embodiment is directed to a switching device and/or a method for opening a housing cover of a switching device, which in an inexpensive and simple manner increase safety during operation and especially when upgrading such a switching device.

Further features and details of the invention emerge from the subclaims, the description and the drawings. In this case features and details which are described in connection with the inventive switching device of course also apply in connection with embodiments of the inventive method and vice versa in each case, so that in respect of the disclosure reference is or can always be made reciprocally to the individual aspects of embodiments of the invention.

An embodiment of the inventive switching device, in particular an electrical circuit breaker, has a housing. A switching unit is disposed inside the housing. The housing is provided with a cover which can be opened, which in turn has a switching opening. A control lever head, which can be moved between an on-position and an off-position, of a control lever for switching the switching unit projects through this switching opening.

An embodiment of the inventive switching device is characterized in that the switching opening has an opening contour and the control lever head has an outer contour. The opening contour and the outer contour are aligned with one another such that the control lever head in an on-position prevents any movement of the housing cover via the control lever head and in the off-position permits movement of the housing cover via the control lever head. Thus the option of opening the housing cover correlates with the position of the control lever or of the control lever head. In this way the housing cover can only be opened with a control lever head which is in the off-position.

BRIEF DESCRIPTION OF THE DRAWINGS

Embodiments of the present invention are explained in greater detail on the basis of the attached drawing figures. The concepts used ("left", "right", "top" and "bottom") refer to an orientation of the drawing figures with normally legible reference characters. The following are shown schematically.

Elements with the same function and effect are each provided with the same reference characters in FIGS. 1 to 10.

DETAILED DESCRIPTION OF THE EXAMPLE EMBODIMENTS

Figure 1:
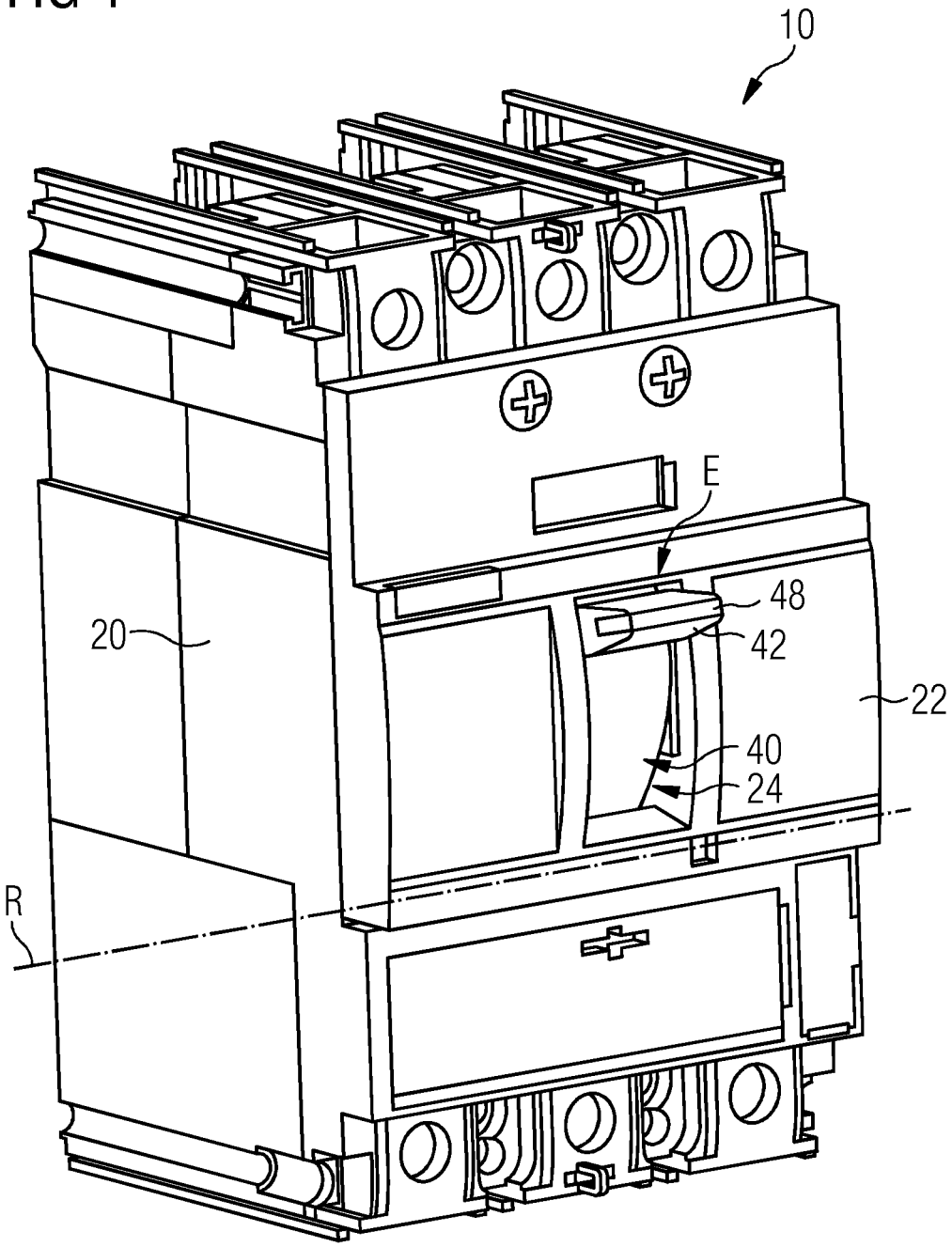
FIG. 1 a perspective illustration of an embodiment of a switching device.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

An embodiment of the inventive switching device is characterized in that the switching opening has an opening contour and the control lever head has an outer contour. The opening contour and the outer contour are aligned with one another such that the control lever head in an on-position prevents any movement of the housing cover via the control lever head and in the off-position permits movement of the housing cover via the control lever head. Thus the option of opening the housing cover correlates with the position of the control lever or of the control lever head. In this way the housing cover can only be opened with a control lever head which is in the off-position.

In this case, opening the housing cover means that the housing cover can be opened far enough for work to be possible in the interior of the housing. This also means that in the context of an embodiment of the present invention it may be possible to open the housing cover slightly in the on-position of the control lever head. However, the control lever head locks the housing cover in the on-position in good time, so that even when the housing cover is slightly open no direct access to the interior of the housing is possible.

Thanks to an inventive switching device the contours, in other words the opening contour and the outer contour, are correlated to ensure that a movement of the control lever head through the switching opening is possible only in the off-position of the control lever head. The result is that in the on-position of the control lever head this movement is locked or prevented and thus the housing cover is geometrically and/or mechanically prevented from opening.

To obtain access to an embodiment of an inventive switching device, in other words into the interior of the housing, the control lever head must first be moved to the off-position. This shuts off the current to the switching unit, and only in this position is it possible to open the housing fully. When additional components are retrofitted the consumer is switched off and no risk is posed by the effect of faults in the consumer circuit. As soon as the control lever head is in the off-position the outer contour of the control lever head and the opening contour inventively correlate, so that the control lever head has removed its mechanical or geometric lock and the housing cover can be opened, in particular fully. Opening the housing cover here means both folding out and/or rotating out, as well as completely removing the housing cover from the rest of the switching device, in particular from the rest of the housing.

The control lever head is preferably a separate part of the control lever and for example is made of plastic. It can be mounted on a corresponding metal plate or metal bracket, in particular clicked or screwed on, in order to extend the control lever through the switching opening. Thus part of the control lever is located on the inside of the housing cover, i.e. in the interior of the housing. Another part, namely the control lever head itself, projects through the switching opening and thus can be accessed from outside the housing and can be operated for the performance of the movement between the on-position and the off-position.

An opening contour and an outer contour in respect of the switching opening and of the control lever head here preferably mean the geometric dimensions of the respective components. The opening contour of the switching opening can represent the edging of the free opening cross-section of this switching opening. The outer contour of the control lever head is preferably essentially designed in one plane which extends to the free end of the control lever head, so that a control lever head or outer contour which become wider are formed. The outer contour need not make the inventive locking fully available. Instead it is sufficient if at a single opening position of the housing cover the outer contour of the control lever head is locked against the opening contour of the switching opening. An embodiment of the inventive advantage is achieved especially easily and inexpensively in this way.

The housing cover of an embodiment of an inventive switching device is in particular an accessory cover, as when open it enables accessories such as auxiliary switches or the like to be introduced into the interior of the housing.

It may be an advantage if in the case of an embodiment of an inventive switching device the control lever head widens out at its free end, in particular in the manner of a hammer-head. The widening defines, in sections in this case, the outer contour of the control lever head. A widening in the manner of a hammer-head is in particular also an essentially symmetrical widening, so that at at least two points, which preferably lie opposite one another, an embodiment of the inventive locking function is enabled by the control lever head against the opening contour of the switching opening. Because of the widening in the manner of a hammer-head or this symmetrical locking any undesired tipping is prevented when an attempt is made to open the housing cover so long as the control lever head is in the on-position. This ensures that when an attempt is made to open the housing cover with the control lever head in the on-position it is especially easy to return to the closing position of the housing cover. A widening can in the context of an embodiment of the present invention also be understood as a widening diagonally to the extension of the control lever head away from the switching unit, outside the housing.

Likewise it is advantageous if in the case of an embodiment of an inventive switching device the switching opening has a locking section and a release section in respect of the opening contour. The locking section and the release section are disposed such that the control lever head is in the on-position in the locking section and in the off-position in the release section. The respective section, i.e. the locking section and the release section, are defined by the geometric embodiment of the opening contour. Thus the free opening cross-section of the switching opening can be divided into the release section and the locking section. The result is that the locking section comprises not only the on-position and the release section not only the off-position, but also corresponding positions of the control lever head therebetween.

In the release section there is preferably a certain clearance between the outer contour of the control lever head and the opening contour of the switching opening. The clearance is in particular in the range between approx. 0.1 mm and approx. 0.5 mm. Preferably the release clearance in the release section is approx. 0.3 mm on each side of the outer contour of the control lever head. In the locking section there is preferably an overlap between the outer contour of the control lever head and the opening contour of the switching opening. This is preferably approx. 1 mm to 2 mm, in particular approx. 1.5 mm. The total width of the control lever head is in such configurations preferably embodied to be between approx. 10 mm and approx. 20 mm.

Another advantage can be achieved in that in the case of an embodiment of an inventive switching device the control lever head has two handling areas lying on different sides of the control lever head for the manual movement of the control lever head between the on-position and the off-position. These handling areas can for example be grip surfaces which can be operated by fingers. In this case lateral surfaces which have at least one locked area extend between the two handling areas. This locked area locks on the opening contour of the switching opening in the on-position against a movement of the control lever head through the switching opening. In the off-position of the control lever head this locked area in contrast permits a movement of the control lever head through the switching opening.

A movement of the control lever head through the switching opening should be understood to mean the opening operation of the housing cover. As this concerns the relative movement between the housing cover and the control lever head, the control lever head must necessarily move through the switching opening in order to open the housing cover. The same is the case in the opposite direction, namely when the housing cover is replaced again and/or closed. This is in particular an unthreading and threading of the control lever head though the switching opening.

This locked area is provided on at least one lateral surface of the control lever head. Obviously, in particular in the case of lateral surfaces with a complex configuration, a plurality, in particular two, of preferably symmetrically distributed locked areas can be provided. In the case of symmetrical distribution, as already described above, any tipping of the housing cover when attempting to open it in the on-position of the control lever head can be reduced or prevented. The lateral surfaces are in particular edges of the control lever head.

It is further advantageous if in the case of an embodiment of an inventive switching device the control lever head has at least one guide area, in particular at least one guide slope, which is embodied to guide, at least in sections, a movement of the control lever head through the switching opening. This guide area can be embodied both for threading and for unthreading. Threading here means the movement of the control lever head through the switching opening in a direction which assists a closing housing cover. Unthreading means the opposite procedure, namely opening the housing cover with a reverse direction of movement of the control lever head through the switching opening.

The guide area is preferably provided on one or more lateral surfaces of the control lever head, or is provided as an edge-side guide area. If the guide area is embodied as a guide slope, it preferably has a gradient of between approx. 10° and approx. 45°. In particular in the case of embodiments which only have a small clearance in the release section, such guidance is of great advantage. It helps to center the control lever head in the release section, so that the desired performance of the opening or closing of the housing cover can be effected even more easily, quickly and safely.

The guide area in particular aids simplified unthreading and/or simplified threading. Preferably at least one such guide area is provided in each case for threading and unthreading.

The embodiment as guide slopes in the case of such multiple guide areas means that these are inclined in a different direction, in particular have an essentially contrary gradient. The position or the gradient can here preferably be defined with reference to the longitudinal axis of the control lever head, i.e. in respect of the extent of its longitudinal axis in the direction of its free end.

Likewise it may be advantageous if in the case of an embodiment of an inventive switching device the housing cover has at least one hinging device, via which the housing cover is mounted on at least one bearing device of the housing about a rotational axis for opening the housing cover. The hinging device can be attached both permanently and also detachably to the rest of the housing. Thus permanent housing hinges, such as for example the embodiment as an integrally embodied film hinge, are conceivable.

Detachable hinging devices, allowing the housing cover to be completely removed when open, are also included in the scope of embodiments of the present invention. Preferably in the case of detachable hinging devices correlations are provided which permit such removal only in the case of a predefined minimum opening angle. Thus there can be a minimum engagement of the hinging devices in the bearing devices, so that in particular complete removal is not yet possible in the case of small opening angles.

The bearing devices are preferably depressions or openings in the housing. They can be embodied to engage behind such hinging devices. Thanks to the hinging devices only rotation in particular is permitted with reference to the degree of freedom of movement of the housing cover. This applies at least as long as the hinging devices are in the desired rotational engagement.

The final attachment can be effected after rotation of the housing cover into the closed position by further connection devices, for example using snap-latch devices or else screws, on the rest of the housing. To open a housing cover, this attachment must first be detached, in order then to perform a rotation about the rotational axis to open the housing cover.

It is further advantageous if in the case of an embodiment of an inventive switching device the at least one hinging device is embodied such that it engages with the at least one bearing device over an engagement angle of the housing cover of up to approx. 40°, i.e. it is not possible to remove the housing cover completely until the opening angle of approx. 40° is reached. Up to approx. 40° opening the engagement is maintained.

If the opening operation is continued by further rotation, the engagement of the hinging device is detached, so that the housing cover can be removed completely from the rest of the housing. In particular the housing cover remains engaged until at least approx. 35°. Thus in particular the hinging device is engaged behind the bearing device. Only if the housing cover is opened further, i.e. the opening angle is increased to a value greater than said engagement angle, can be it detached.

An embodiment of an inventive switching device can be further developed such that the opening contour of the switching opening and the outer contour of the control lever head are aligned with one another so that in the on-position of the control lever head a rotation of the housing cover of more than approx. 30°, in particular of more than the engagement angle, is locked. In other words it is ensured that the control lever head in the on-position locks the opening of the housing cover in good time, even before the opening angle of the housing cover has reached or exceeded the engagement angle. Preferably the rotation is permitted up to a maximum of approx. 10°. Thus there is sufficient safety as regards the correlation to the engagement angle, so that although it is possible to start opening the housing cover when the control lever head is in the on-position, it cannot be detached completely.

A slight opening of approx. 10° also achieves the desired safety, so that access into the interior is not possible even when the housing cover is open approx. 10°. Therefore sufficient free space can be left between the completely closed housing cover and the control lever head so that in a particularly advantageous manner it is possible to access the control lever head to move it between the on-position and the off-position.

It is likewise advantageous if in the case of an embodiment of an inventive switching device the control lever head, in particular on its lateral surfaces, has at least one optical marker for the optical identification of the position of the control lever head. An optical marker can for example be a separate component which is stuck on, screwed on or clicked on. In particular this optical marker has a signal color which contrasts with the color of the rest of the control lever head. A contrast with the coloring of the housing cover is also expedient. Thus the optical marker ensures that the position of the control lever head can be identified even more easily and safely. For example, the optical marker is embodied as a white click element which is clicked on to an essentially black control lever head.

It is also possible that in the case of an embodiment of an inventive switching device the control lever head has at least one mechanical interface for attaching a lever extension in force-transmitting manner. This mechanical interface can for example have a screw connection or a snap-latch connection. Lever extensions can be attached here to enable the necessary force to be introduced easily via the control lever head by way of a long lever when high switching forces are present. At the same time the overall depth is not impaired in the case of such switches, as the lever reduction is preferably configured to be removable.

It may be further advantageous if in the case of an embodiment of an inventive switching device the control lever head has at least one separable material region with a rupture joint the course of which is such that the mechanical interface is formed by detaching the material region. This means that in particular a depression, preferably in the form of a latching depression, is made available. Thus one and the same control lever head can be used for a plurality of different switching devices, so that by simply modifying and breaking the rupture joint the desired extendibility for a lever extension is made available.

A further subject of an embodiment of the present invention is a method for opening a housing cover of a switching device according to an embodiment of the present invention, the control lever head being moved into the off-position and the housing cover then being opened by moving the control lever head through the switching opening. Thus an embodiment of an inventive method entails the same advantages as have been explicitly explained with reference to an embodiment of an inventive switching device. The opening can of course be both a wide opening as well as a complete removal of the housing cover.

FIG. 1 provides a schematically perspective illustration of an embodiment of an inventive switching device 10. It has a housing 20, in the interior of which (not shown in FIG. 1) a switching unit 30 is disposed.

Figure 4:
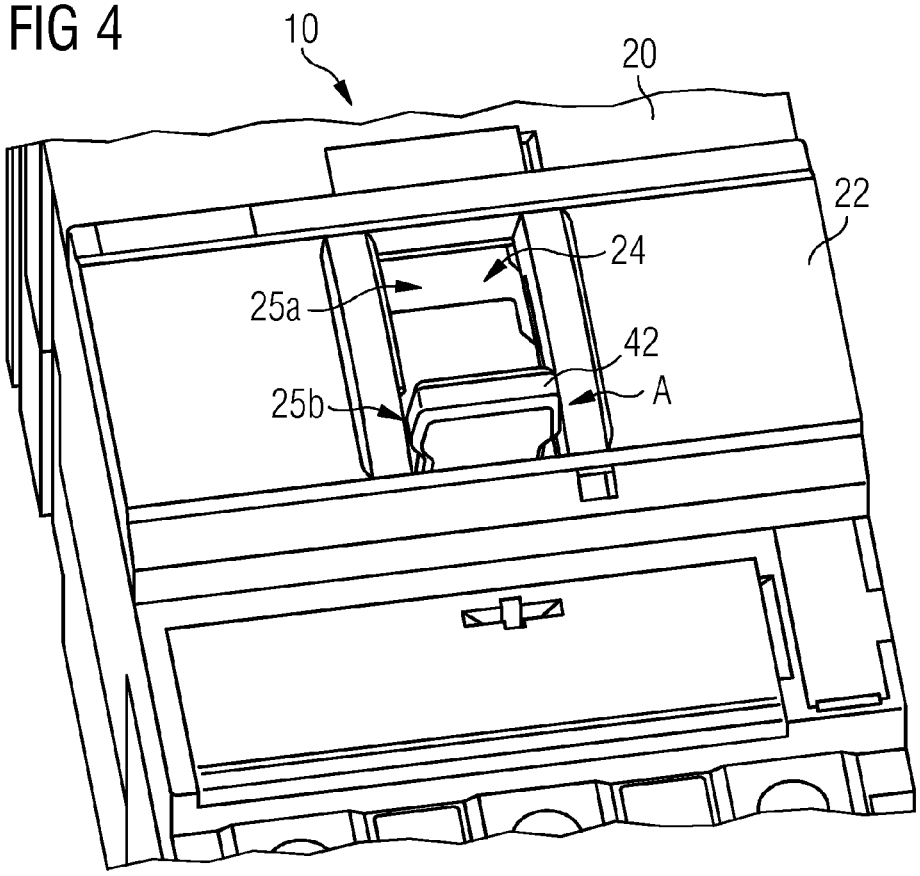

The switching unit 30 can be switched via a control lever 40. The control lever 40 has a control lever head 42 which projects through a switching opening 24 of a housing cover 22. FIG. 1 illustrates a situation in which the control lever head 42 is in an on-position E. The control lever head 42 can be moved back and forth between the position as shown in FIG. 1 and a position according to FIG. 4. In FIG. 4 the control lever head 42 is positioned in the off-position A. The positioning of the control lever head 42 between the on-position E and the off-position A serves to switch the switching unit 30, and means that in the off-position A the switching unit 30 is de-energized in the interior of the housing 20.

Figure 6:
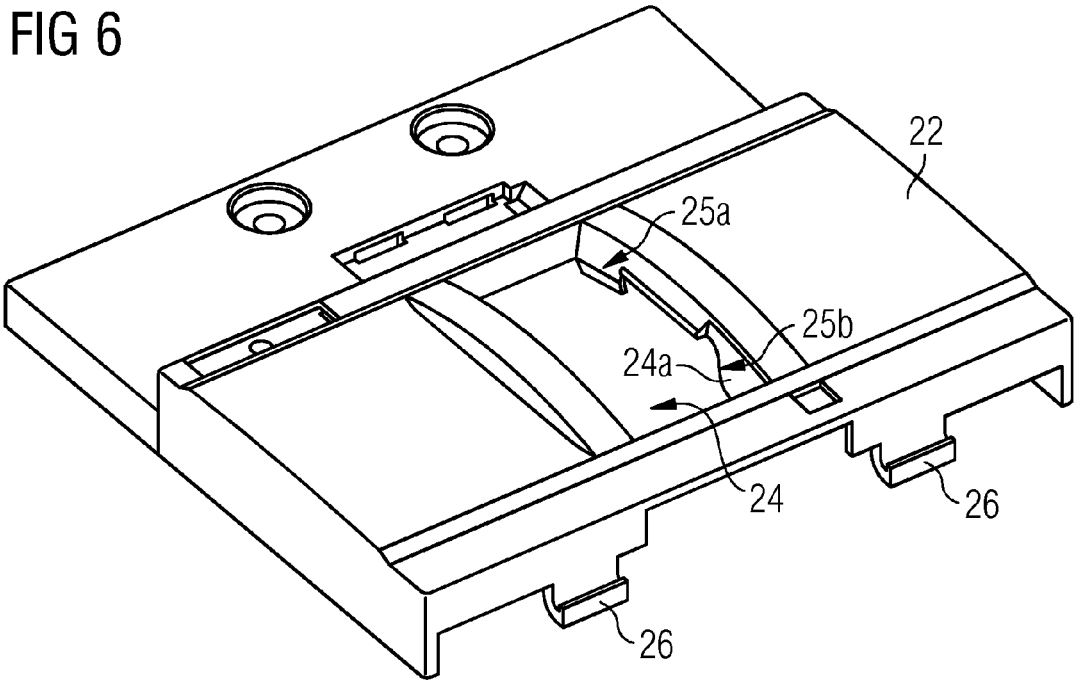

In order to make modifications in the interior of the housing 20 the housing cover 22 must be opened. An attempt at such an opening is for example illustrated in FIG. 2. In order for the housing cover 22 to be opened it is provided with hinging device 26, which for example can be readily identified in FIG. 6. Corresponding bearing devices are provided in the housing 20, but are not shown in the figures and may be simple openings or relief cuts.

Via the hinging device 26 the housing cover 22 engages with the housing 20, in particular the bearing device, and thereby forms a rotational axis R. The housing cover 22 can be pivoted about this rotational axis R to perform the opening movement.

Figure 2:
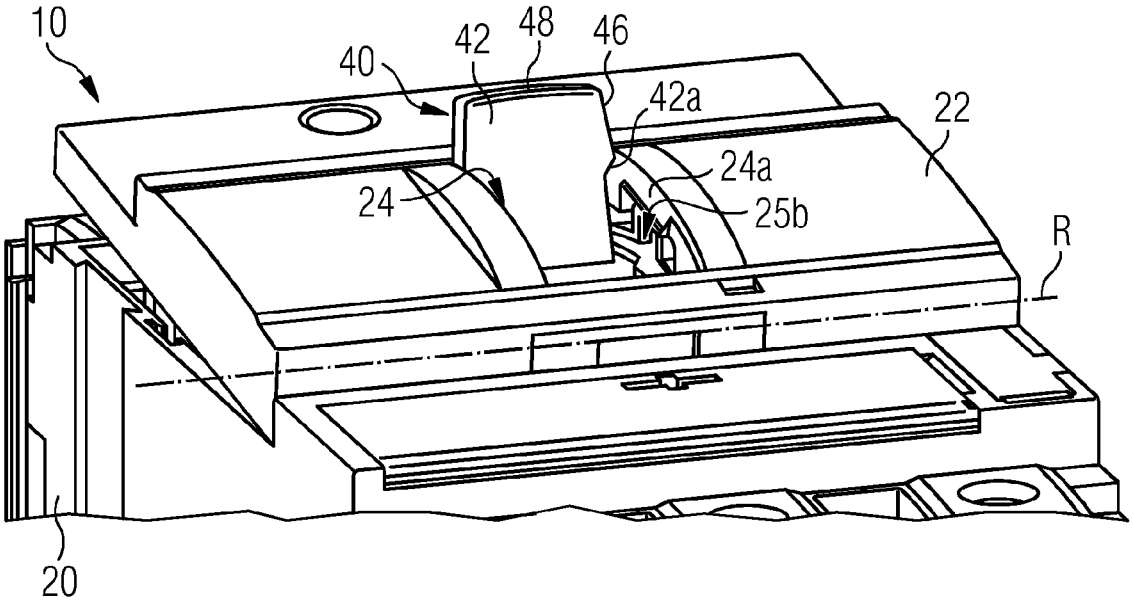
FIG. 2 the switching device from FIG. 1 with a slightly open housing cover, FIG. 3 a schematic cross-section with the control lever head in the on-position, FIG. 4 a partial view with the control lever head in the off-position, FIG. 5 the embodiment from FIG. 4 in schematic cross-section, FIG. 6 an individual illustration of the housing cover of an embodiment, FIG. 7 a detailed view of the switching opening of an embodiment, FIG. 8 a detailed view of the control lever of an embodiment, FIG. 9 a detailed view of the optical marker of an embodiment and FIG. 10 a detailed view during the use of a lever extension of an embodiment.
Figure 3:
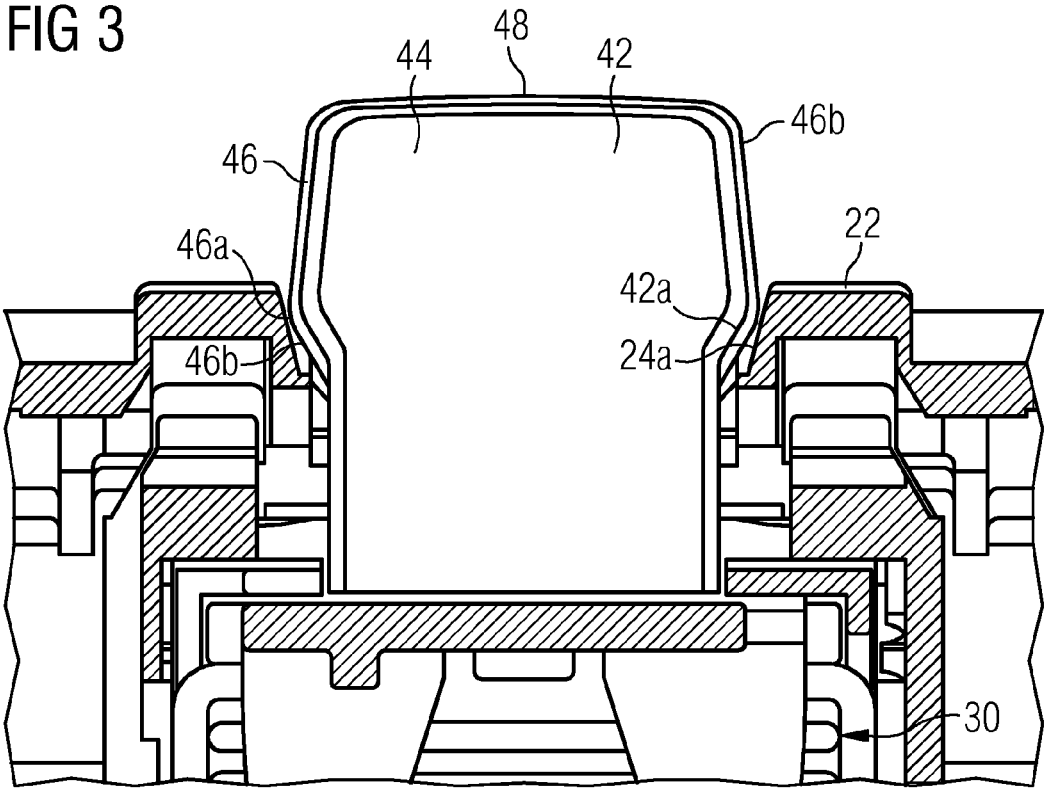

FIG. 2 illustrates the attempted opening. However, the control lever head 42 is in the on-position E, so that the control lever head 42 is locked against a movement through the switching opening 24. FIG. 3 shows this in more detail, for example, where the correlation of the opening contour 24*a* of the switching opening 24 with the outer contour 42*a* of the control lever head 42 can be identified. Between two handling areas 44 this control lever head 42 has a lateral surface 46 with two locked areas 46*a*. In the position shown in FIG. 2 the locked areas 46*a* abut the outer contour 24*a* of the switching opening 24 and so prevent any further movement of the housing cover 22 relative to the control lever head 42. In other words a mechanical lock is achieved for the movement of the control lever head 42 of the control lever 40 through the switching opening 24.

Figure 5:
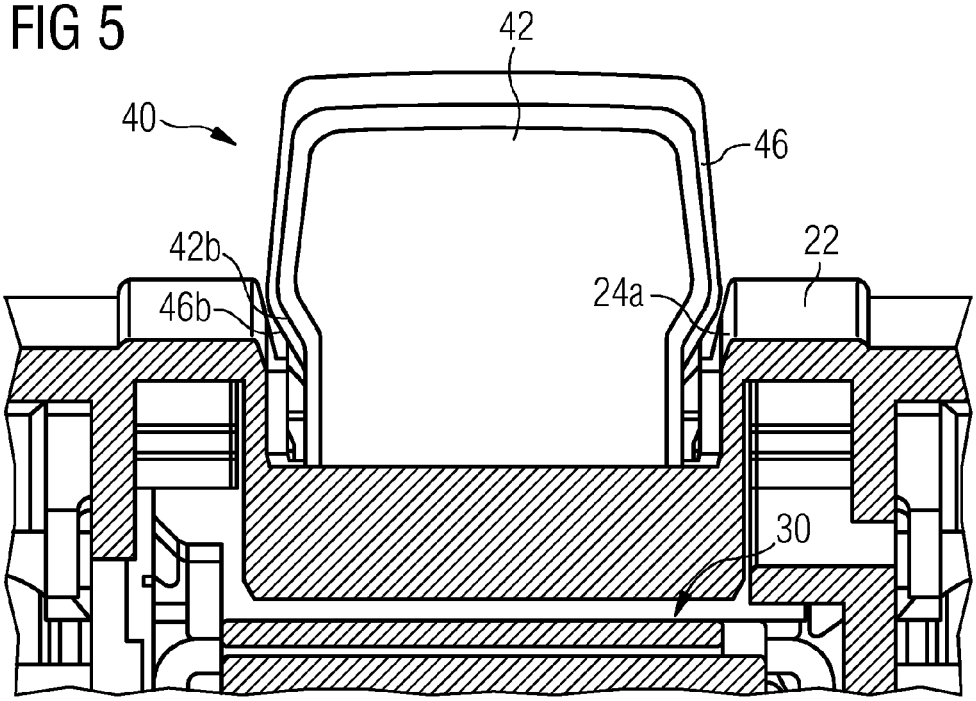

Also readily identifiable are the guide areas 46*b*, which are likewise disposed on the lateral surface 46 of the control lever head 42. Their function is explained in greater detail on the basis of FIGS. 4 and 5, in which the control lever head 42 is in the off-position A. Thus the housing cover 22 can be opened without difficulty. This is apparent for example in the schematic cross-section in FIG. 5. The locked areas 46*a* are not in engagement, so that the contours of the switching opening 24 and the control lever head 42 permit a corresponding relative movement through the switching opening 24. As a relatively small clearance of the contours 24*a* and 42*a* predominates in this release section 25*b*, the bottom guide areas 46*b* are provided on the left and right side of the control lever head 42. These ensure that an essentially automatic centering of the housing cover 22 relative to the control lever head 42 is performed, so that any inadvertent locking in this release position of the release section 25*b* is prevented.

Figure 7:
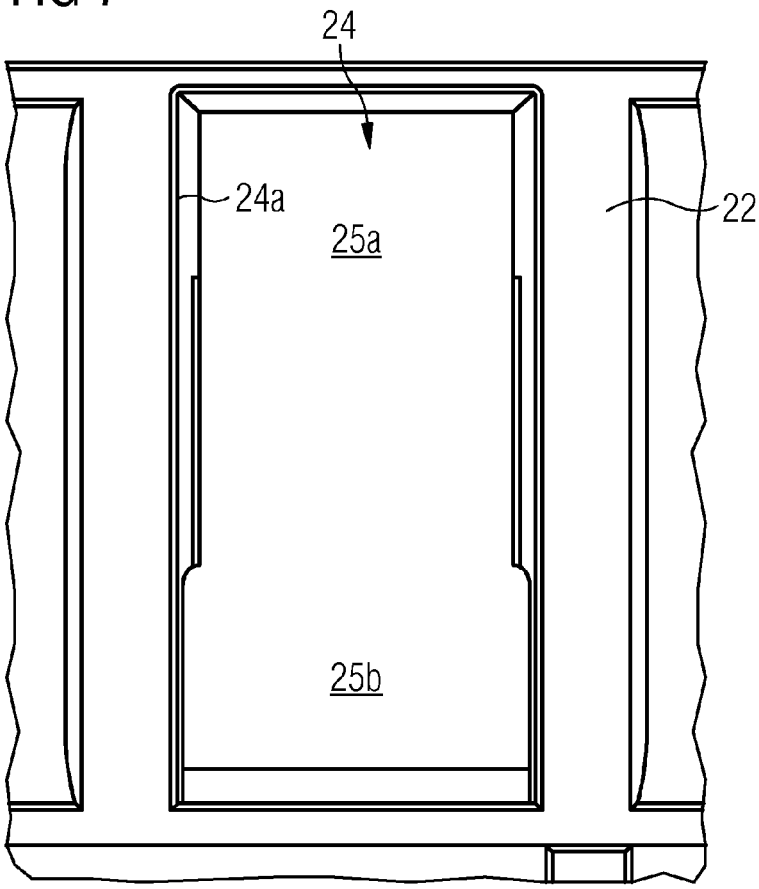
Figure 8:
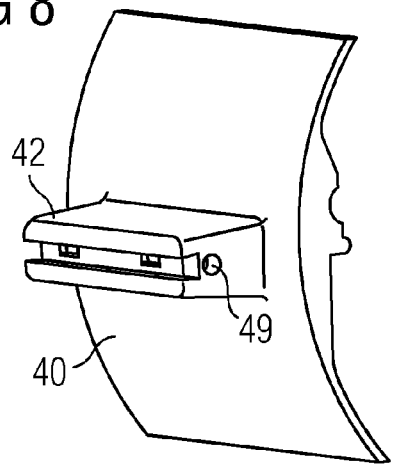

FIGS. 7 and 8 show the housing cover 22 removed. Here it is likewise readily apparent that thanks to the outer contour 24*a* of the switching opening a locking section 25*a* and a release section 25*b* can be distinguished from one another because of corresponding cross-section widening of the free opening cross-section.

Figure 9:
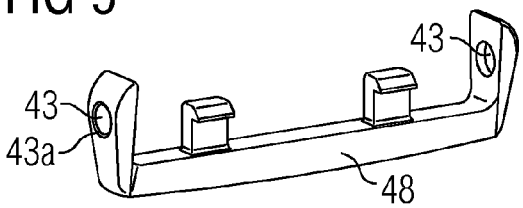
Figure 10:
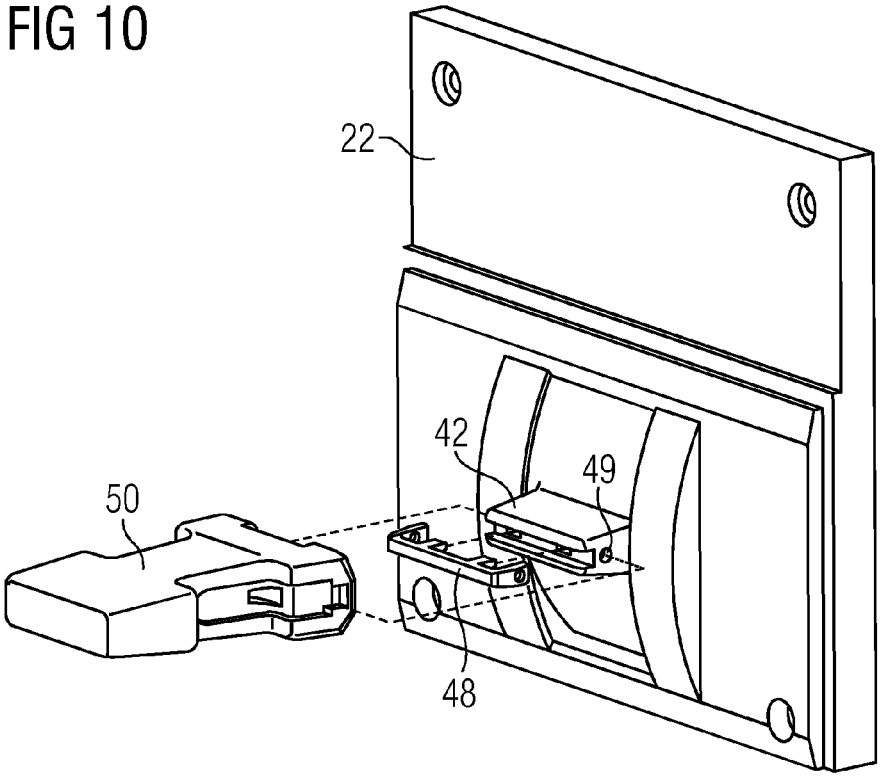

FIGS. 8 to 10 show a further embodiment of an inventive switching device. Here the control lever 40, in particular the control lever head 42, is provided with a lever extension 50. A mechanical interface 49 in the form of a snap-latch depression is provided for this. At the same time a clip 48 is used, which is clicked onto the control lever head 42. If, for example because of high switching forces, a lever extension 50 is desired, a material region 43 of the clip 48 can be broken out by way of rupture joints 43*a*, in order to make a latching depression available as a mechanical interface 49 in the desired manner. The lever extension 50 can then be clicked reversibly or irreversibly onto the control lever head 42 or onto the clip 48.

The material region 43 of the clip 48 ensures that if the clip 48 is clicked onto the control lever head 42 any movement of the housing cover via the control lever head 42 is prevented in the on-position (E), and in the off-position (A) a movement of the housing cover 22 via the control lever head 42 is permitted.

If the material range 43 of the clip 48 has been broken out and a lever extension 50 placed onto the control lever head 42, the shape of the lever extension 50 ensures that in the on-position (E) a movement of the housing cover (22) via the control lever head 42 is prevented, and in the off-position (A) a movement of the housing cover 22 via the control lever head 42 is permitted.

The above explanation of the embodiments describes the present invention only in the context of examples. Individual features of the embodiments can of course, where technically expedient, be freely combined with one another without departing from the scope of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A switching device, comprising:

a housing; and a switching unit disposed inside the housing, the housing including an openable housing cover, with a switching opening through which a control lever head, movable between an on-position and an off-position, of a control lever for switching the switching unit projects, the switching opening including an opening contour and the control lever head including an outer contour which are aligned with one another such that the control lever head in the on-position prevents any movement of the housing cover via the control lever head, and such that the control lever head in the off-position permits a movement of the housing cover via the control lever head, wherein the housing cover includes at least one hinging device via which the housing cover is mounted about a rotational axis for opening the housing cover on at least one bearing device of the housing.

2. The switching device of claim 1, wherein the control lever head widens at its free end.

3. The switching device of claim 1, wherein the switching opening, in relation to the opening contour, includes a locking section and a release section which are disposed such that the control lever head is in the on-position in the locking section and in the off-position in the release section.

4. The switching device of claim 1, wherein the control lever head includes two handling areas lying on different sides of the control lever head for the manual movement of the control lever head between the on-position and the off-position, the lateral surfaces extending between the two handling areas having at least one locked area which on the opening contour of the switching opening in the on-position locks any movement of the control lever head through the switching opening, and in the off-position permits a movement of the control lever head through the switching opening.

5. The switching device of claim 1, wherein the control lever head includes at least one guide area embodied to guide, at least in sections, a movement of the control lever head through the switching opening.

6. The switching device of claim 1, wherein the at least one hinging device is embodied to engage with the at least one bearing device over an engagement angle of the housing cover of up to approx. 40°.

7. The switching device of claim 1, wherein the opening contour of the switching opening and the outer contour of the control lever head are aligned with one another such that in the on-position of the control lever head a rotation of the housing cover of more than 30° is locked.

8. The switching device of claim 1, wherein the control lever head, in particular on its lateral surfaces, includes at least one optical marker for the optical identification of the position of the control lever head.

9. The switching device of claim 1, wherein the control lever head includes at least one mechanical interface for attaching a lever extension in a force-transmitting manner.

10. The switching device of claim 9, wherein the control lever head includes at least one separable material region with a rupture joint, the course of which is such that the mechanical interface is embodied by detaching the material region.

11. A method for opening a housing cover of a switching device of claim 1, comprising:

moving the control lever head being moved into the off-position; and opening the housing cover by a movement of the control lever head through the switching opening.

12. The switching device of claim 1, wherein the switching device is an electrical circuit breaker.

13. The switching device of claim 2, wherein the control lever head widens in the manner of a hammer-head.

14. The switching device of claim 5, wherein the control lever head includes one guide slope embodied to guide, at least in sections, a movement of the control lever head through the switching opening.

15. The switching device of claim 1, wherein the opening contour of the switching opening and the outer contour of the control lever head are aligned with one another such that in the on-position of the control lever head a rotation of the housing cover of more than the engagement angle is locked.

16. The switching device of claim 6, wherein the opening contour of the switching opening and the outer contour of the control lever head are aligned with one another such that in the on-position of the control lever head a rotation of the housing cover of more than the engagement angle is locked.

17. The switching device of claim 8, wherein the control lever head includes at least one optical marker on its lateral surfaces.

18. The switching device of claim 1, wherein the control lever head includes a frangible clip inserted in an end most surface of the control lever head.

* * * * *